US011830656B2

(12) United States Patent
Yen et al.

(10) Patent No.: US 11,830,656 B2
(45) Date of Patent: Nov. 28, 2023

(54) TRANSFORMER DEVICE

(71) Applicant: Realtek Semiconductor Corporation, Hsinchu (TW)

(72) Inventors: Hsiao-Tsung Yen, Hsinchu (TW); Ka-Un Chan, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 392 days.

(21) Appl. No.: 17/035,855

(22) Filed: Sep. 29, 2020

(65) Prior Publication Data

US 2021/0398739 A1 Dec. 23, 2021

(30) Foreign Application Priority Data

Jun. 19, 2020 (TW) ..... 109120713

(51) Int. Cl.
*H01F 27/28* (2006.01)
*H01F 27/29* (2006.01)

(52) U.S. Cl.
CPC ..... *H01F 27/2823* (2013.01); *H01F 27/29* (2013.01)

(58) Field of Classification Search
CPC ..... H01F 27/2823
USPC ..... 336/232
See application file for complete search history.

(56) References Cited

U.S. PATENT DOCUMENTS 8,493,169 B2 * 7/2013 Paek ..... H01F 5/003 336/200
2006/0125589 A1 * 6/2006 Tamata ..... H01F 17/0013 336/200
2008/0094166 A1 * 4/2008 Hsu ..... H01F 41/041 336/223
2008/0284552 A1 * 11/2008 Lim ..... H01L 23/5227 336/200
2016/0027571 A1 * 1/2016 Zhang ..... H01F 19/04 336/173
2019/0237238 A1 8/2019 Yen et al.

FOREIGN PATENT DOCUMENTS

TW 201834177 A 9/2018
TW I645429 B 12/2018
TW 201931390 A 8/2019
TW I699791 B 7/2020

* cited by examiner

*Primary Examiner* — Ronald Hinson
(74) *Attorney, Agent, or Firm* — Locke Lord LLP; Tim Tingkang Xia, Esq.

(57) ABSTRACT

A transformer device includes a first coil and a second coil. The first coil includes a number of first circles. The second coil includes a number of second circles. A first side of a first one of the first coil is adjacent to one of the first coil, and a second side of the first one of the first coil is adjacent to one of the second coil. A first side and a second side of a second one of the first coil are adjacent to one of the second coil, respectively.

18 Claims, 4 Drawing Sheets

TRANSFORMER DEVICE

CROSS-REFERENCE TO RELATED APPLICATION

The present application claims priority to Taiwan Application Serial Number 109120713, filed Jun. 19, 2020, which is incorporated herein by reference in its entirety.

BACKGROUND

Technical Field

The present disclosure relates to an electronic device. More particularly, the present disclosure relates to a transformer device.

Description of Related Art

In existing technology, the stacked or spiral inductors can be designed with different winding methods according to different application requirements. However, different winding methods have their corresponding advantages and disadvantages. For example, the wires in the same coil of the spiral structure will have higher mutual inductance value, but cause a problem of higher parasitic capacitance correspondingly. Therefore, it is important to achieve balance among inductance, quality factor, parasitic capacitance and other related factors.

SUMMARY

In order to solve the problem mentioned above, the present disclosure provides a transformer device including a first coil and a second coil. The first coil includes a number of first circles. The second coil includes a number of second circles. A first side of a first one of the first coil is adjacent to one of the first coil, and a second side of the first one of the first coil is adjacent to one of the second coil. A first side and a second side of a second one of the first coil are adjacent to one of the second coil, respectively.

It is to be understood that both the foregoing general description and the following detailed description are by examples, and are intended to provide further explanation of the invention as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
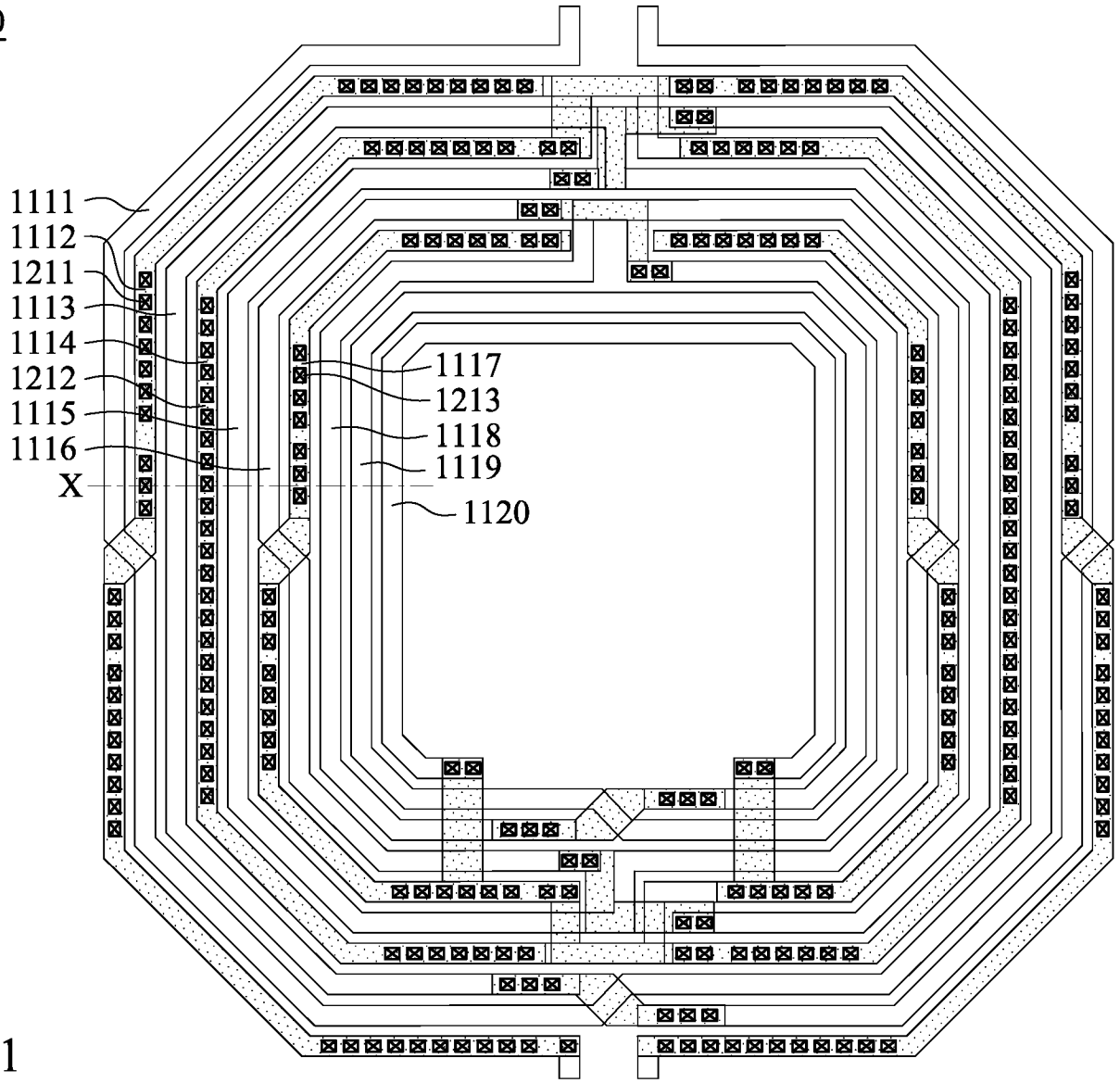
FIG. 1 is a schematic diagram illustrating a transformer device, in accordance with some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

It will be understood that, although the terms first, second, third etc. may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present disclosure.

The terms herein are used for describing particular embodiments and are not intended to be limited thereto. Single forms such as "a," "this," "the," as used herein also include the plurality form.

In the description herein and throughout the claims that follow, the terms "coupled" or "connected" in this document may be used to indicate that two or more elements physically or electrically contact with each other, directly or indirectly. They may also be used to indicate that two or more elements cooperate or interact with each other.

In the description herein and throughout the claims that follow, the terms "comprise," or "comprising," "include," or "including," "have," or "having," "contain," or "containing," and the like used herein are to be understood to be open-ended, i.e., to mean including but not limited to.

In the description herein and throughout the claims that follow, the phrase "and/or" includes any and all combinations of one or more of the associated listed claims.

In the description herein and throughout the claims that follow, unless otherwise defined, all terms have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference is now made to FIG. 1. FIG. 1 is a schematic diagram illustrating a transformer device 1000 in accordance with some embodiments of the present disclosure.

Figure 2:
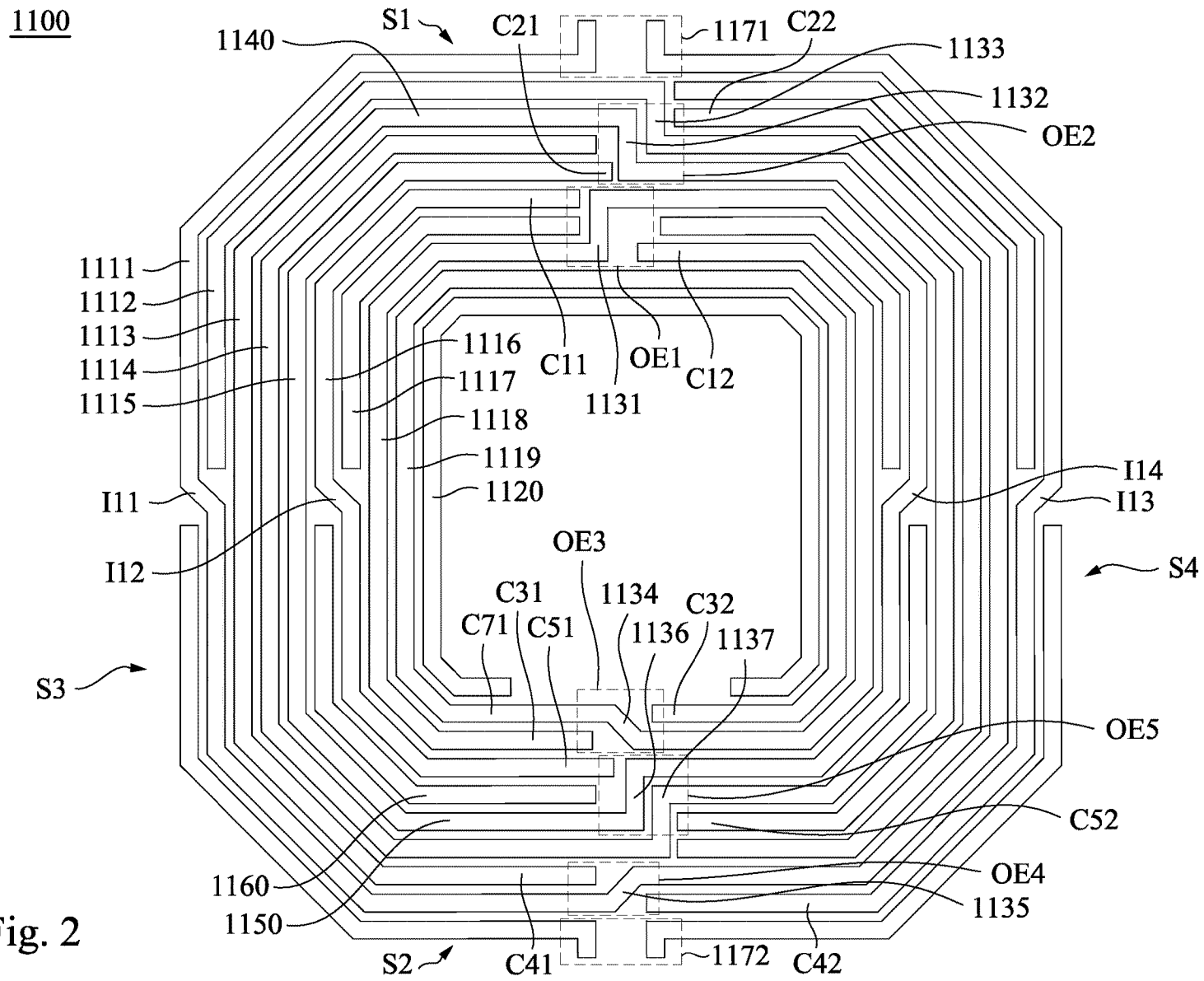
FIG. 2 is a schematic diagram illustrating a partial structure of the transformer device shown in FIG. 1, in accordance with some embodiments of the present disclosure.
Figure 3:
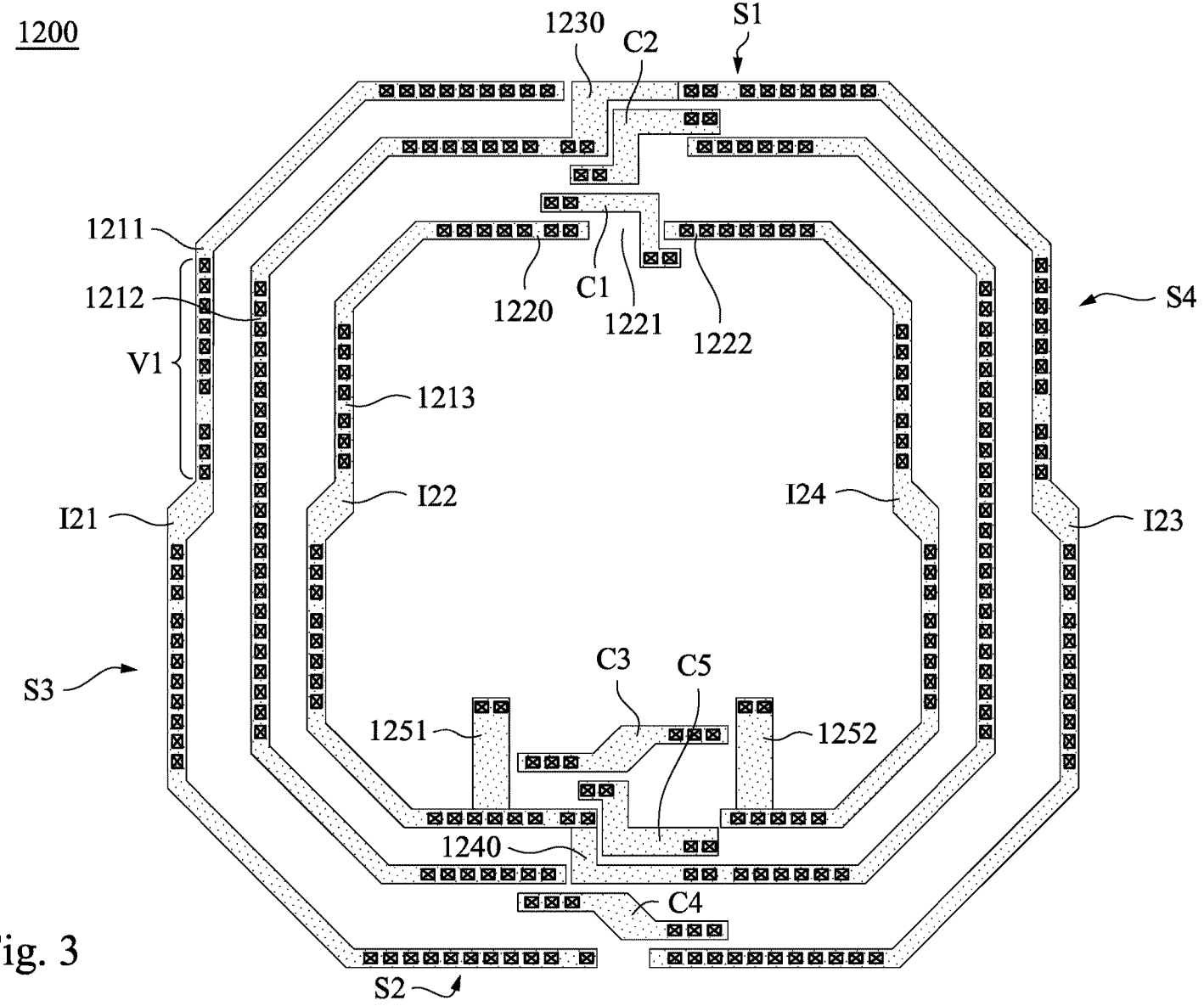
FIG. 3 is a schematic diagram illustrating a partial structure of the transformer device shown in FIG. 1, in accordance with some embodiments of the present disclosure.

For ease of understanding, a transformer device 1000 shown in FIG. 1 can be separated into a first coil 1100 of the transformer device 1000 shown in FIG. 2 and a second coil 1200 of the transformer device 1000 shown in FIG. 3. The first coil 1100 includes first wires 1111~1120, and the second coil 1200 includes second wires 1211~1213. In some embodiments, the second wire 1211 is overlapped on the first wire 1112, the second wire 1212 is overlapped on the first wire 1114, and the second wire 1213 is overlapped on the first wire 1117.

In some embodiments, the second wire 1211 and the second wire 1212 are located at two sides of the first wire 1113 respectively, the first wire 1115 is located at one side of the first wire 1116, and the second wire 1213 is located at the other side of the first wire 1116. In other words, a part of the first wire(s) of the first coil 1100 have both sides adjacent to the second wire of the second coil 1200, and the other part of the first wire(s) of the first coil 1100 have one side adjacent to the first wire and the other side adjacent to the second wire.

In some embodiments, from the top view of the cross section line X shown in FIG. 1, the transformer device 1000 includes the first wire 1111, the second wire 1211, the first wire 1113, the second wire 1212, the first wire 1115, the first wire 1116, the second wire 1213, the first wire 1118, the first wire 1119, and the first wire 1120, disposed from outside to inside. Structures and connections of the first coil 1100 and the second coil 1200 of the transformer device 1000 will be described in more details in the follow paragraphs.

References are now made to FIG. 1, FIG. 2 and FIG. 3. FIG. 2 is a schematic diagram illustrating a first coil 1100 of the transformer device 1000 shown in FIG. 1, in accordance with some embodiments of the present disclosure. FIG. 3 is a schematic diagram illustrating a second coil 1200 of the transformer device 1000 shown in FIG. 1, in accordance with some embodiments of the present disclosure.

In some embodiments, the first wires of the first coil 1100 are disposed on the first metal layer, and the second wires of the second coil 1200 are disposed on the second metal layer, in which the first wire and the second wire can be coupled by a vertical connector (e.g., via). For example, via(s) V1 shown in FIG. 3 are configured to couple the first wire 1111 to the second wire 1211. The patterns same as via(s) V1 shown in figure are configured to represent vertical connectors, which is configured to couple the first wires and the second wires disposed on different metal layers. For simplicity of illustration, it will not be described repeatedly in the present disclosure. It is noted that, the amount and the position of the vertical connectors are not limited to those shown in the figure.

In some embodiments, a first side S1 is at the upper side of the transformer device 1000, and a second side is at the lower side of the transformer device 1000, in which the first side S1 is in parallel with the second side S2. In some embodiments, a third side S3 is at the left side of the transformer device 1000, and a fourth side S4 is at the right side of the transformer device 1000, in which the third side S3 is in parallel with the fourth side S4, and the first side S1 and the second side S2 are substantially perpendicular to the third side S3 and the fourth side S4.

In some embodiments, the first side S1 of the transformer device 1000 includes an opening 1221 between the second wire 1220 and the second wire 1222. In some embodiments, the first side S1 of the transformer device 1000 includes a first connector C1 and a second connector C2 disposed on the second metal layer. The first connector C1 is a Z-shaped structure with right angle, and is configured to go through the opening 1221 to connect an opening OE1 between the partial first wire C11 and the partial first wire C12, and to cross the first wire 1131, and crosses the first wire 1131 which is in vertical direction. The second connector C2 is a Z-shaped structure with right angle, and is configured to connect an opening OE2 between the partial first wire C21 and the partial first wire C22. The second connector C2 crosses the first wire 1132 and the first wire 1133 disposed vertically.

In some embodiments, the second wire 1230 turns in a Z-shape on the first side S1, and crosses the first wire 1140.

In some embodiments, the transformer device 1000 further includes a first input/output terminal 1171 disposed on the first side S1, which is formed by extension of the outermost first wire on the first side S1.

In some embodiments, the second side S2 of the transformer device 1000 includes a third connector C3, a fourth connector C4 and a fifth connector C5 disposed on the second metal layer. The third connector C3 is a Z-shaped structure, and is configured to connect an opening OE3 between a partial first wire C31 and a partial first wire C32. The third connector C3 crosses the first wire 1134, and forms a X-shaped structure with the first wire 1134. The fourth connector C4 is a Z-shaped structure, and is configured to connect an opening OE4 between a partial first wire C41 and a partial first wire C42. Also, the fourth connector C4 crosses the first wire 1135, and form an X-shaped structure with the first wire 1135. The fifth connector C5 is a Z-shaped structure with right angle, and is configured to connect an opening OE5 between a partial first wire C51 and a partial first wire C52, and the fifth connector C5 crosses the first wire 1136 and the first wire 1137 disposed vertically.

In some embodiments, the second wire 1240 turns in a Z-shape on the second side S2, and crosses the first wire 1150.

In some embodiments, the partial first wire C51, the partial first wire C31 and the first wire C71 are crossed by the second wire 1251 and the second wire 1252, to connect two terminals of the first wire located at innermost side.

In some embodiments, the transformer device 1000 further includes a second input/output terminal 1172 disposed on the second side S2, which is formed by extension of the outermost first wire on the second side S1.

In some embodiments, the third side S3 of the transformer device 1000 includes the partial first wire I11 interlaced with the partial second wire I21, and the partial first wire I12 interlaced with the partial second wire I22. In this way, the interlacing area of the first coil 1100 and the second coil 1200 on the first side S1 and the second side S2 can be reduced (e.g., the first wire 1150 is the only one crossed by the second wire 1240 on the second side S2). For example, in some embodiments, when the partial first wire I12 is not interlaced with the partial second wire I22 on the third side S3 (not shown in figure), the first wire 1150 and the first wire 1160 are crossed by the second wire 1240 in the second side S2.

In some embodiments, the fourth side S4 of the transformer device 1000 includes a partial first wire I13 interlaced with a partial second wire I23. In some embodiments, the fourth side S4 of the transformer device 1000 further includes a partial first wire I14 interlaced with a partial second wire I24. When the transformer device 1000 includes the partial first wire I11 interlaced with the partial second wire I21 on the third side S3, and includes the partial first wire I12 of the first wire interlaced with the partial second wire I22 on the third side S3, the third side S3 of the transformer device 1000 is symmetrical to the fourth side S4 of the transformer device 1000, and the interlacing area of the first coil 1100 and the second coil 1200 on the first side S1 and the second side S2 are reduced correspondingly, such that the resistance of the transformer device 1000 can be reduced and the quality factor of the transformer device 1000 can be increased.

Figure 4:
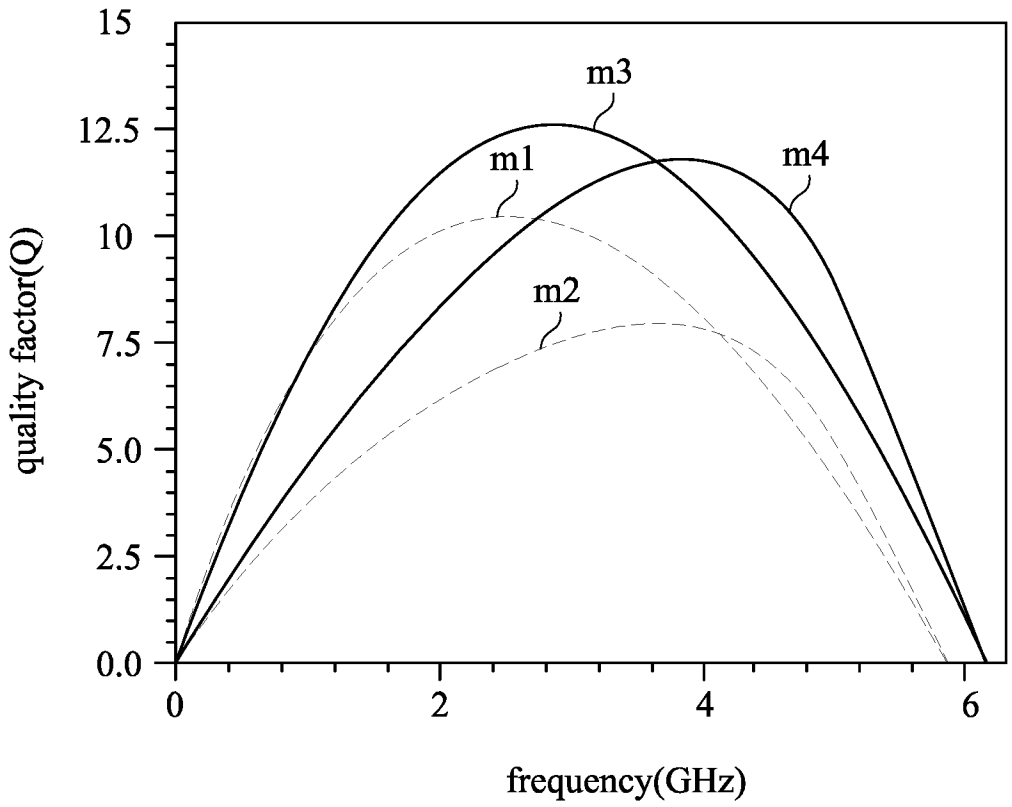
FIG. 4 is a schematic diagram illustrating experimental data of the transformer device, in accordance with some embodiments of the present disclosure.

FIG. 4 is a schematic diagram illustrating experimental data of the transformer device 1000 shown in FIG. 1, in accordance with some embodiments of the present disclosure. As shown in FIG. 4, quality factor of the experimental curves of the coils of the conventional transformer device without structural configuration according to the present disclosure are m1 and m2, and the experimental curves of the first coil and the second coil of the transformer device 1000 with the structural configuration according to the present disclosure are m3 and m4. As shown in FIG. 4, the quality factor of the transformer device 1000 has higher quality factor at a frequency of 2.4 GHz and a frequency of 5 GHz. Therefore, it can be seen that the transformer device 1000 with the structural configuration according to the present disclosure has better quality.

In sum, with interlacing, crossing and overlapping of the first wires and the second wires, the transformer device in the present disclosure has better structural symmetry and quality factor (Q).

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A transformer device, comprising:

a first coil comprising a plurality of first wires disposed at a first metal layer; and a second coil comprising a plurality of second wires disposed at a second metal layer, wherein the second wires overlap on a part of the first wires and couple the part of the first wires through a vertical connector, and any two adjacent second wires disposed at the second metal layer are separated by at least one of the first wires that does not be overlapped by the second wires and are disposed at the first metal layer;

wherein a first side of a first one of the plurality of first wires is adjacent to one of the plurality of first wires, and a second side of the first one of the plurality of first wires is adjacent to one of the plurality of second wires, wherein a first side and a second side of a second one of the plurality of first wires are adjacent to one of the plurality of second wires, respectively.

2. The transformer device of claim 1, wherein the first metal layer is different from the second metal layer.

3. The transformer device of claim 1, wherein the first side and the second side are located at opposite sides of the transformer device.

4. The transformer device of claim 1, wherein three of the plurality of first wires are arranged adjacently at an innermost side of the transformer device.

5. The transformer device of claim 4, wherein the second coil comprises an opening at a first side of the transformer device.

6. The transformer device of claim 5, wherein at least one of the plurality of second wires crosses the three of the plurality of first wires to be coupled to an innermost first wire of the plurality of first wires.

7. The transformer device of claim 6, wherein two terminals of the innermost first wire of the plurality of first wires are coupled to one of the plurality of second wires respectively, at a second side of the transformer device.

8. The transformer device of claim 1, wherein one of the plurality of first wires is interlaced with one of the plurality of second wires, at a first side of the transformer device.

9. The transformer device of claim 8, wherein one of the plurality of first wires is interlaced with one of the plurality of second wires, at a second side of the transformer device.

10. The transformer device of claim 1, wherein one of the plurality of first wires is crossed by one of the plurality of second wires at a first side of the transformer device.

11. The transformer device of claim 10, wherein the first coil further comprises a first opening and a second opening at a first side of the transformer device, and the second coil further comprises a first connector and a second connector at the first side of the transformer device, wherein the one of the plurality of first wires is crossed by the first connector, and two of the plurality of first wires is crossed by the second connector, wherein the first connector and the second connector are configured to connect the first opening and the second opening respectively.

12. The transformer device of claim 11, wherein one of the plurality of first wires is crossed by one of the plurality of second wires at a second side of the transformer device.

13. The transformer device of claim 12, wherein the first side and the second side are located at opposite sides of the transformer device.

14. The transformer device of claim 12, further comprising:

a first input/output terminal, disposed on one of the plurality of first wires located at outermost side of the first side of the transformer device.

15. The transformer device of claim 12, further comprising:

a second input/output terminal, disposed on one of the plurality of first wires located at outermost side of the second side of the transformer device.

16. The transformer device of claim 12, wherein the first coil further comprises a third opening, a fourth opening, and a fifth opening at the second side of the transformer device, and the second coil further comprises a third connector, a fourth connector, and a fifth connector at the second side of the transformer device, wherein one of the plurality of first wires is crossed by the third connector and the fourth connector respectively, and two of the plurality of first wires are crossed by the fifth connector, wherein the third connector, the fourth connector and the fifth connector are configured to connect the third opening, the fourth opening and the fifth opening respectively.

17. The transformer device of claim 16, wherein the first connector, the second connector and the fifth connector are z-shaped structures with right angle.

18. The transformer device of claim 16, wherein the first connector, the second connector, the third connector, the fourth connector and the fifth connector are disposed on sane metal layer.

* * * * *